US006308539B1

(12) United States Patent
Kolton et al.

(10) Patent No.: US 6,308,539 B1
(45) Date of Patent: Oct. 30, 2001

(54) ARTICLE IDENTIFICATION AND SURVEILLANCE TAG

(75) Inventors: Chester Kolton, Westfield; Michael Norman, East Brunswick, both of NJ (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 09/350,443

(22) Filed: Jul. 9, 1999

(51) Int. Cl.[7] ..... E05B 65/00
(52) U.S. Cl. ..... 70/57.1; 292/307 R
(58) Field of Search ..... 70/57.1; 292/307 R; 283/98; 340/572

(56) References Cited

U.S. PATENT DOCUMENTS 4,299,870 * 11/1981 Humble ..... 70/57.1 X
5,079,540 * 1/1992 Narlow et al. ..... 70/57.1 X
5,088,165 * 2/1992 Minasy et al. ..... 70/57.1 X
5,119,652 * 6/1992 Costa ..... 70/57.1
5,144,820 * 9/1992 Holmgren ..... 70/57.1
5,306,055 * 4/1994 Mainetti ..... 292/320
5,421,177 * 6/1995 Sieber et al. ..... 70/57.1
5,524,463 * 6/1996 Schenkel et al. ..... 70/57.1
5,655,392 * 8/1997 Holmgren ..... 70/57.1
5,945,909 * 8/1999 Kolton ..... 340/572.1
5,955,951 * 9/1999 Wischerop et al. ..... 340/572.8
6,082,156 * 7/2000 Bin ..... 70/57.1

* cited by examiner

*Primary Examiner*—Suzanne Dino Barrett
(74) *Attorney, Agent, or Firm*—Robin, Blecker & Daley

(57) ABSTRACT

An article protection tag comprises a first housing defining a compartment therein, an EAS member disposed in the compartment and a second housing fabricated separately from the first housing, the first and second housings jointly defining structure for locking the first housing to the second housing with any one of a plurality of predetermined fixed spacings between facing surfaces of the first and second housings interiorly of the locking structure.

5 Claims, 3 Drawing Sheets

ARTICLE IDENTIFICATION AND SURVEILLANCE TAG

FIELD OF THE INVENTION

This invention relates generally to article identification and protection and pertains more particularly to tags having size adaptiveness to articles.

BACKGROUND OF THE INVENTION

One type of article identification device having security aspects and having virtual universal applicability to articles is the so-called "seal", such as is shown in U.S. Pat. No. 5,306,055. The seal of the '055 patent comprises a plastic body having a flexible cord passing through and secured in the body and extending outwardly of the body to a cord free end which has hooks secured thereto and of configuration providing for irreversible insertion in the plastic body. In addition to the body and the cord, the seal of the '055 patent has plates bearing logo/article indication applied to the plastic body to close the same. In use, the hook and cord are passed through an opening of, e.g., a watch band, and the hook is then inserted into the plastic body.

A widespread further practice in article security is the use of so-called anti-theft tags which incorporate electronic article surveillance (EAS) markers. Such tags are secured to articles and are removed or rendered inactive at checkout. Where fraudulent avoidance of checkout (shop-lifting) occurs, the markers are sensed by EAS systems, e.g., at store exits, and suitable alarm is generated.

One form of EAS marker in widespread use is in the form of a flat, thin, flexible, rectangular member which is applied adhesively to flat or curved surfaces of articles.

In pending, allowed U.S. patent application Ser. No. 09/088,839, now U.S. Pat. No. 5,945,909, commonly-assigned herewith, there is shown a seal incorporating therewithin an EAS marker.

Known seals, such as those above discussed, have a common shortcoming in that they are not adaptive to the size of articles with which they are assembled.

SUMMARY OF THE INVENTION

The primary object of the subject invention is to provide tags which are adaptive to the size of articles with which they are assembled.

In broad aspect, the invention provides tags, the article engaging elements of which can tightly circumscribe articles of different sizes. To this end, the invention provides tags having first and second separately fabricated housings having respective locking means for securing the housings to one another with articles of varying sizes securable interiorly of the secured housings.

More particularly, an article protection tag in accordance with the invention comprises a first housing defining a compartment therein, an EAS member disposed in the compartment and a second housing separate from the first housing, the first and second housings jointly defining means for locking the first housing to the second housing with any one of a plurality of predetermined fixed spacings between facing surfaces of the first and second housings interiorly of the locking means.

In another aspect, the invention comprises, in combination, an article of manufacture having a constituent component generally rectangular in cross-section and an article protection tag comprising a first housing defining a compartment therein, an EAS member disposed in the compartment and a second housing, the first and second housings jointly defining means for locking the first housing to the second housing, one of the housing means for locking including first and second locking members mutually spaced by at least a first dimension of the article of manufacture cross-section and having lengths exceeding a second dimension of the article of manufacture cross-section.

The invention will be further understood from consideration of the following description of preferred embodiments thereof and from the drawings where like reference numerals identify like parts throughout.

DETAILED DESCRIPTION OF THE PREFERRED EMBODIMENTS

Figure 1:
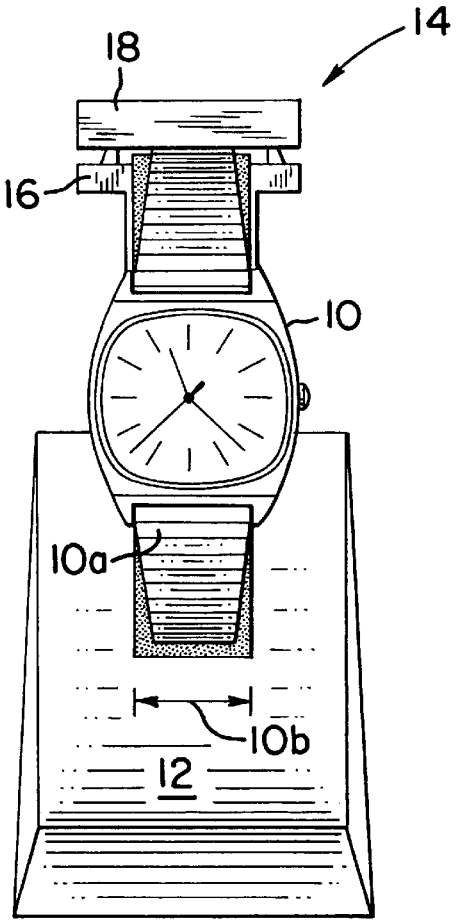
FIG. 1 is a front elevation of a wristwatch mounted on a display member and bearing a first article protection tag in accordance with the invention.

Referring to FIGS. 1–4, wristwatch 10 is supported on display member 12 and has tag 14 secured therewith. Tag 14 is comprised of first and second, separately fabricated, housings 16 and 18. Housing 16 defines an interior compartment 20 in which EAS member 22 is secured. Housing 16 is elongate and has ratchet members 24 and 26 extending longitudinally from facing surface 16*a* thereof, a preselected transverse spacing S being provided between the ratchet members.

First and second openings 18*b* and 18*c* are provided in facing surface 18*a* of housing 18 at transverse spacing S, the housing preferably being hollow or otherwise having channels permitting free movement of ratchet members 24 and 26 therethrough. Openings 18*b* and 18*c* are of transverse width less than the transverse width of teeth 24*a* and 26*a* of ratchet members 24 and 26, whereby only unidirectional movement, vertical upward movement in FIG. 3, of the ratchet members into housing 18 is permitted.

Figure 4:
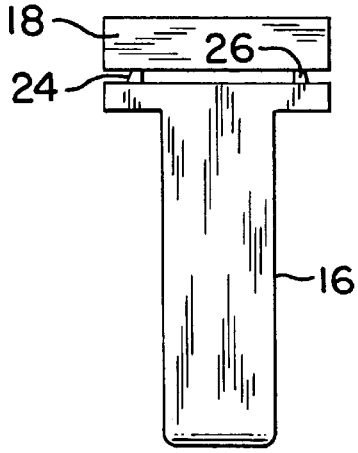
FIG. 4 is a front elevation of the housings of FIG. 3 secured to one another without the wristwatch secured therewith.
Figure 3:
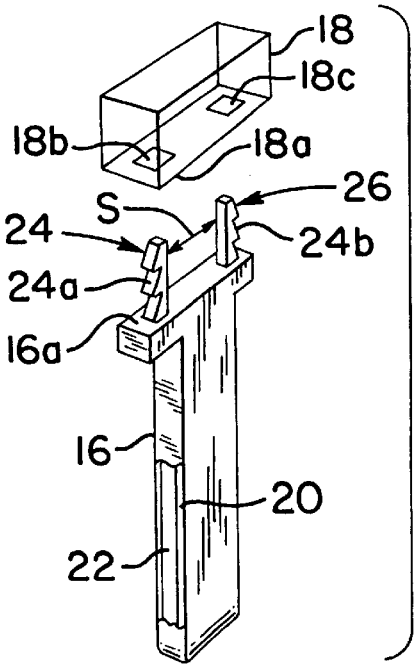
FIG. 3 is an exploded perspective view of the housings of the article protection tag of FIG. 1 with one housing broken away in part and the other housing shown transparently to show interior details thereof.

As will be appreciated, housings 16 and 18 are securable in either one of two mutual spacings of facing surfaces 16*a* and 18*a*, i.e., a first spacing as defined by the uppermost teeth of ratchet members 24 and 26 being detented against downward movement by housing 18 surface bounding openings 18*a* and 18*b* and a second spacing as defined by the second uppermost teeth of ratchet members 24 and 26 being detented against downward movement by housing 18 surface bounding openings 18*b* and 18*c*. The second spacing is shown in FIG. 4.

Figure 2:
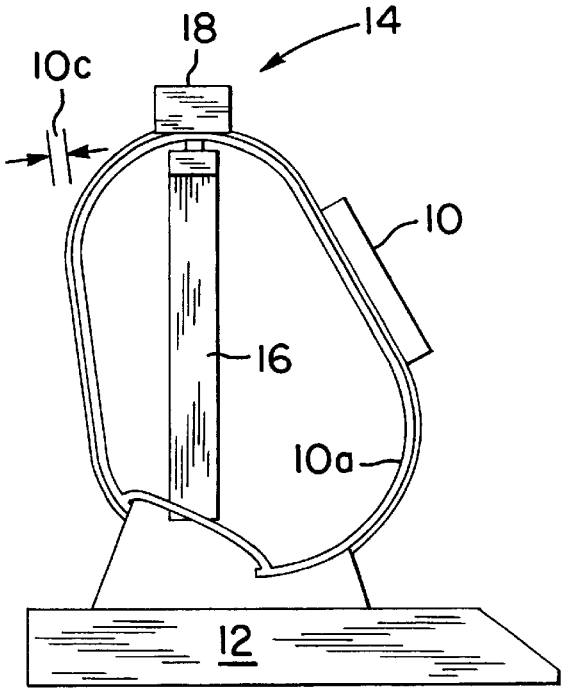
FIG. 2 is a left side elevation of FIG. 1.

As is seen in FIGS. 1 and 2, the strap 10*a* of wristwatch 10 is of generally rectangular cross-section, having width 10*b* and thickness 10*c*. Per the invention, in the means for locking the first housing to the second housing, one of the housing means for locking includes first and second locking members mutually spaced by at least a first dimension of the article of manufacture cross-section and having lengths exceeding a second dimension of the article of manufacture cross-section. To this end, ratchet members 24 and 26 are mutually spaced by transverse spacing S which exceeds width 10*b* of strap 10*a* and have lengths exceeding the thickness 10*c* of strap 10*a*.

In assembling tag 16 with wristwatch 10, housing 16 is placed interiorly of strap 10*a*, as shown in FIG. 2, with facing surface 16*a* engaging the interior surface of strap 10*a* and with rachet members 24 and 26 on opposite sides of the strap margins. Housing 18 is now placed outwardly of the strap with openings 18*b* and 18*c* aligned with ratchet members 24 and 26. Housing 18 is now forced downwardly onto the strap until ratchet members 24 and 26 are secured within housing 18.

Referring to FIGS. 5–8, wristwatch 10 is supported on display member 12 and has tag 28 secured therewith. Tag 28 is comprised of first and second, separately fabricated, housings 30 and 32. As in the case of housing 16, housing 30 defines an interior compartment in which an EAS member (not shown) is secured. Housing 32 has ratchet members 34 and 36 extending downwardly from facing surface 32*a* thereof, the preselected transverse spacing S being provided between the ratchet members.

Housing 30 is elongate and has openings 30*b* and 30*c* formed in its facing surface 30*a* at transverse spacing S. Housing 30 is preferably hollow or otherwise has channels permitting free movement of ratchet members 34 and 36 therethrough. Openings 30*b* and 30*c* are of transverse width less than the transverse width of the teeth 34*a* and 36*a* of ratchet members 34 and 36, whereby only unidirectional movement, vertical downward movement in FIG. 6, of the ratchet members into housing 30 is permitted.

Figure 8:
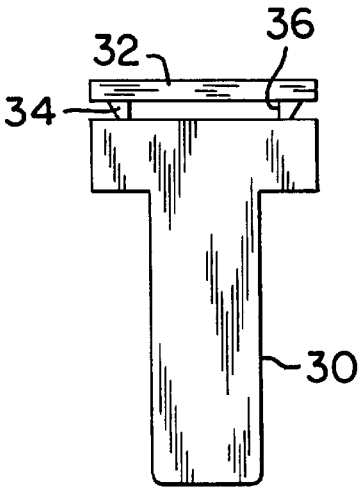
FIG. 8 is a front elevation of the housings of FIG. 7 secured to one another without the wristwatch secured therewith.
Figure 7:
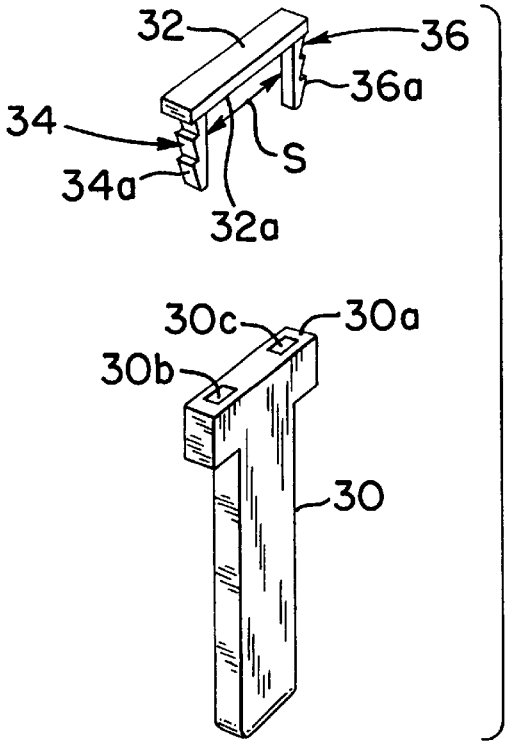
FIG. 7 is an exploded perspective view of the housings of the article protection tag of FIG. 5.

As in the case of the tag embodiment of FIGS. 1–4, housings 30 and 32 are securable in either one of two mutual spacings of facing surfaces 30*a* and 32*a*, i.e., a first spacing as defined by the lowermost teeth of ratchet members 34 and 36 being detented against downward movement by housing 30 surface bounding openings 30*b* and 30*c* and a second spacing as defined by the second lowermost teeth of ratchet members 34 and 36 being detented against downward movement by housing 30 surface bounding openings 30*b* and 30*c*. The second spacing is shown in FIG. 8.

Figure 5:
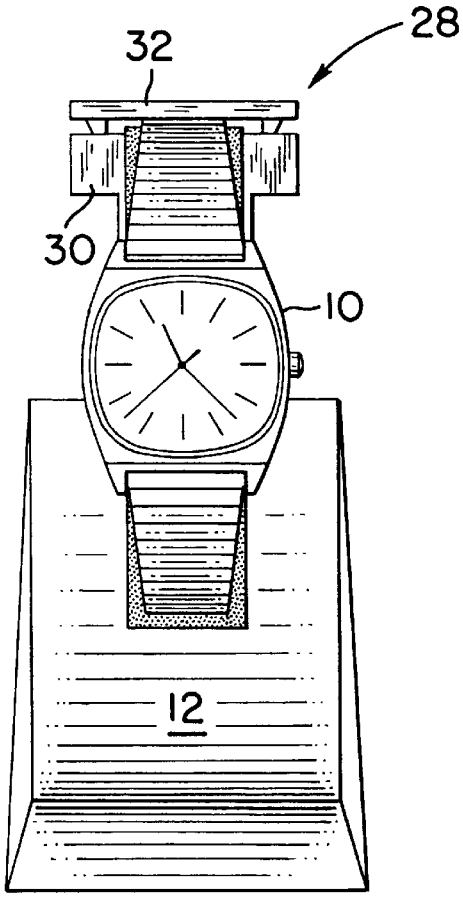
FIG. 5 is a front elevation of a wristwatch mounted on a display member and bearing a second article protection tag in accordance with the invention.
Figure 6:
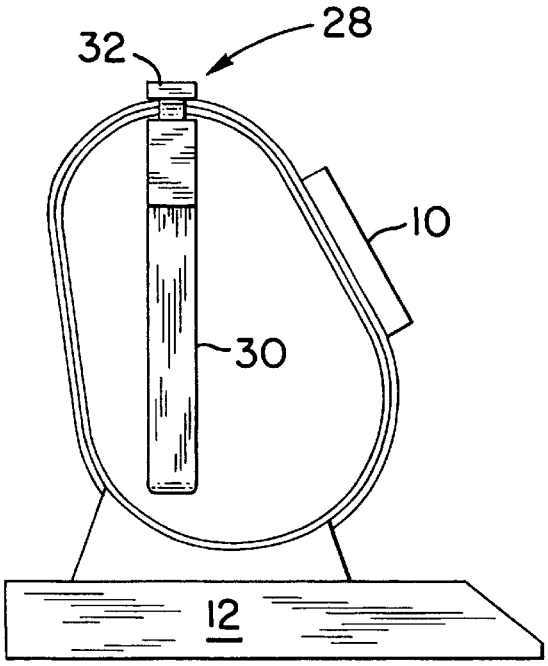
FIG. 6 is a left side elevation of FIG. 5.

As is seen in FIGS. 5 and 6, the strap 10*a* of wristwatch 10 is of generally rectangular cross-section. Per the invention, in the means for locking the first housing to the second housing, one of the housing means for locking includes first and second locking members mutually spaced by at least a first dimension of the article of manufacture cross-section and having lengths exceeding a second dimension of the article of manufacture cross-section. To this end, ratchet members 34 and 36 are mutually spaced by transverse spacing S which exceeds the width of strap 10*a* and have lengths exceeding the thickness of strap 10*a*.

Referring to FIGS. 9–13, wristwatch 10 is supported on display member 12 and has tag 38 secured therewith. Tag 38 is comprised of first and second, separately fabricated, housings 40 and 42. As in the case of housing 16, housing 40 defines an interior compartment in which an EAS member (not shown) is secured. Housing 40 is elongate and has ratchet members 44 and 46 extending transversely from facing surface 40*a* thereof, the aforementioned transverse spacing S being provided between the ratchet members.

First and second openings 42*b* and 42*c* are provided in facing surface 42*a* of housing 42 at transverse spacing S, the housing preferably being hollow or otherwise having channels permitting free movement of the ratchet members 44 and 46 therethrough. Openings 42*b* and 42*c* are of transverse width less than the transverse width of the teeth of ratchet members 44 and 46, whereby only unidirectional movement, to the left in FIG. 12, of the ratchet members into housing 42 is permitted.

Figure 12:
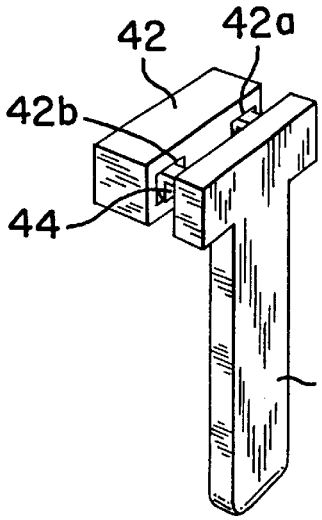
FIG. 12 shows the housings of the FIG. 9 tag without the wristwatch therewith secured to one another in a first mutual spacing.
Figure 13:
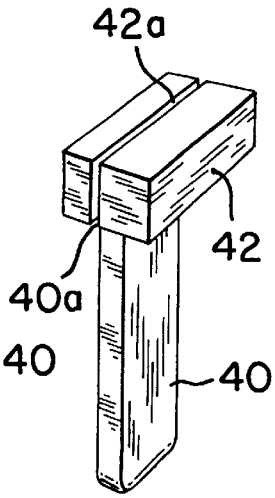
FIG. 13 shows the housings of the FIG. 9 tag without the wristwatch therewith secured to one another in a second mutual spacing.

As will be appreciated, housings 40 and 42 are securable in either one of two mutual spacings of facing surfaces 40*a* and 40*a*, i.e., a first spacing as defined by the outermost teeth of ratchet members 44 and 46 being detented against separating movement in FIG. 12 by housing 42 surface bounding openings 42*b* and 42*c* and a second spacing as defined by the second outermost teeth of ratchet members 44 and 46 being detented against separating movement in FIG. 12 by housing 42 surface bounding openings 42*b* and 42*c*. The first spacing is shown in FIG. 13 and the second spacing is shown in FIG. 12.

Figure 9:
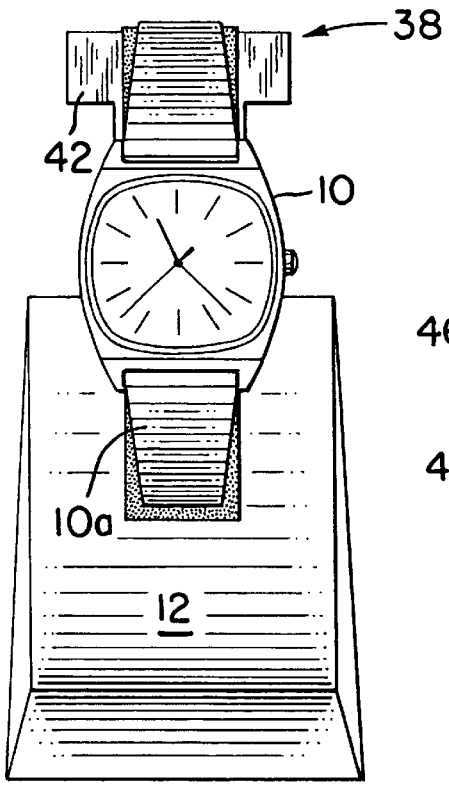
FIG. 9 is a front elevation of a wristwatch mounted on a display member and bearing a third article protection tag in accordance with the invention.
Figure 10:
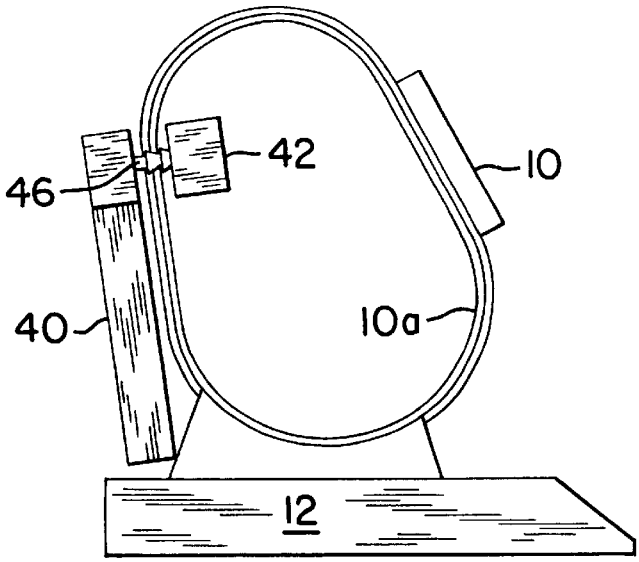
FIG. 10 is a left side elevation of FIG. 9.
Figure 11:
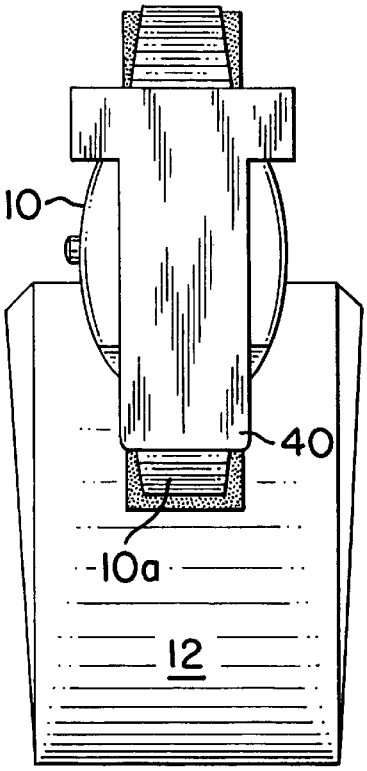
FIG. 11 is a top plan view of the FIG. 9 showing.

As is seen in FIGS. 9 and 10, the strap 10*a* of wristwatch 10 is of generally rectangular cross-section. Per the invention, in the means for locking the first housing to the second housing, one of the housing means for locking includes first and second locking members mutually spaced by at least a first dimension of the article of manufacture cross-section and having lengths exceeding a second dimension of the article of manufacture cross-section. To this end, ratchet members 44 and 46 are mutually spaced by transverse spacing S which exceeds the width of strap 10*a* and have lengths exceeding the thickness of strap 10*a*.

Various changes may be introduced in the disclosed preferred embodiments without departing from the invention. For example, while the plurality of spacings defined between the lockable housings is two, this number may be expanded to include other spacings simply by expanding the number of teeth on the ratchet members. Accordingly, it is to be appreciated that the true spirit and scope of the invention is set forth in the following claims.

What is claimed is:

1. An article protection tag comprising:

a first housing defining a compartment therein;

an EAS memer disposed in said compartment; and a second housing separate from said first housing, said first and second housings jointly defining means for locking said first housing to said second housing with any one of a plurality of predetermined fixed spacings between facing surfaces of said first and second housings interiorly of said locking means, said locking means comprising first and second mutay spaced locking members extending from one of said first and second housings for respectively receiving and retaining said first and second locking members, wherein said first housing is elongate and wherein the direction of locking of said first housing and said second housing is longitudinal of said first housing, wherein said locking members comprise first and second ratchet members extending longitudinally from said facing source of said first housing with a preselected transverse spacing therebetween.

2. The tag claimed in claim 1, wherein said locking means further comprises first and second openings in said facing surface of said second housing, said openings being mutually spaced at said preselected transverse spacing, said first and second openings being configured respectively to receive said first and second ratchet members and to permit only unidirectional movement of said ratchet means with respect to said second housing.

3. In combination:

an article of manufacture having a constituent component generally rectangular in cross-section; and an article protection tag comprising:

a first housing defining a compartment therein;

an EAS member disposed in said compartment; and a second housing, said first and second housings each defining means for locking said first housing to said second housing, one of said means for locking including first and second locking members mutually spaced by at least a first dimension of said article of manufacture cross-section and having lengths exceeding a second dimension of said article of manufacture cross-section, wherein said first housing is elongate and wherein the direction of locking of said first housing and said second housing is longitudinal of said first housing, wherein said locking means comprises first and second ratchet members extending longitudinally from said facing surface of said first housing with a preselected transverse spacing therebetween.

4. The invention claimed in claim 3, wherein said locking means further comprises first and second openings in said facing surface of said second housing said openings being mutually spaced at said preselected transverse spacing, said first and second openings being configured respectively to receive said first and second ratchet members and to permit only unidirectional movement of said ratchet means into said send housings.

5. In combination:

an article of manufacture having a constituent component generally rectangular in cross-section; and an article protection tag comprising a first housing defining a compartment therein;

an EAS member disposed in said compartment; and a second housing, said first and second housings jointly defining means for locking said first housing to said second housing, one of said housing locking means including first and second locking members mutually spaced by at least a first dimension of said article of manufacture cross-section and having lengths exceeding a second dimension of said article of manufacture cross-section.

* * * * *

UNITED STATES PATENT AND TRADEMARK OFFICE

CERTIFICATE OF CORRECTION

PATENT NO. : 6,308,539 B1
DATED : October 30, 2001
INVENTOR(S) : Chester Kolton et al.

It is certified that error appears in the above-identified patent and that said Letters Patent is hereby corrected as shown below:

Column 4,
Line 66, delete “mutay” and insert -- mutually --.

Column 6,
Line 15, delete “said send” and insert -- said second --.

Signed and Sealed this

Twenty-first Day of January, 2003

JAMES E. ROGAN
*Director of the United States Patent and Trademark Office*